US011479839B2

(12) United States Patent
Tatsuzawa et al.

(10) Patent No.: US 11,479,839 B2
(45) Date of Patent: Oct. 25, 2022

(54) METHOD FOR PRODUCING HOT-ROLLED TITANIUM PLATE

(71) Applicant: NIPPON STEEL CORPORATION, Tokyo (JP)

(72) Inventors: Yoshitsugu Tatsuzawa, Tokyo (JP); Tomonori Kunieda, Tokyo (JP); Kenichi Mori, Tokyo (JP); Kazuhiro Takahashi, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 284 days.

(21) Appl. No.: 16/757,140

(22) PCT Filed: Oct. 26, 2017

(86) PCT No.: PCT/JP2017/038776

§ 371 (c)(1),
(2) Date: Apr. 17, 2020

(87) PCT Pub. No.: WO2019/082352

PCT Pub. Date: May 2, 2019

(65) Prior Publication Data

US 2020/0340092 A1 Oct. 29, 2020

(51) Int. Cl.

| | |
|---|---|
| ***C22F 1/18*** | (2006.01) |
| ***B21B 1/02*** | (2006.01) |
| ***B21B 3/00*** | (2006.01) |

(52) U.S. Cl.

CPC ..... *C22F 1/183* (2013.01); *B21B 1/026* (2013.01); *B21B 3/003* (2013.01)

(58) Field of Classification Search

CPC ..... C22F 1/183; B21B 1/026; B21B 3/003; B21B 15/00; B21B 3/00; B21B 27/005;
(Continued)

(56) References Cited

U.S. PATENT DOCUMENTS

2002/0052165 A1* 5/2002 Mori ..... B21B 28/04 451/5
2011/0318597 A1 12/2011 Takahashi et al.
(Continued)

FOREIGN PATENT DOCUMENTS

CN 105102679 A 11/2015
JP 7-251202 A 10/1995
(Continued)

*Primary Examiner* — John A Hevey
(74) *Attorney, Agent, or Firm* — Birch, Stewart, Kolasch & Birch, LLP

(57) ABSTRACT

A method for producing a hot-rolled titanium plate includes, [1] melting at least one part of the side surface of the titanium slab by radiating a beam or plasma toward the side surface, not toward the surface to be rolled, and thereafter causing re-solidification to form, in the side surface, a layer having grain diameter of 1.5 mm or less and a depth of 3.0 mm or more from the side surface; [2] performing a finishing process on the surface to be rolled of the titanium slab in which the layer is formed, to thereby bring a slab flatness index X to 3.0 or less; and [3] subjecting the titanium slab after the finishing process to hot rolling under a condition in which a length of an arc of contact of a roll L in a first pass of rough rolling is 230 mm or more.

17 Claims, 3 Drawing Sheets

(58) Field of Classification Search
CPC ... B21B 37/16; B21B 45/004; B21B 2265/14; B22D 21/06
See application file for complete search history.

(56) References Cited

U.S. PATENT DOCUMENTS

| | | | | |
|---|---|---|---|---|
| 2014/0212688 | A1* | 7/2014 | Smith | A61L 27/06 72/203 |
| 2016/0038983 | A1* | 2/2016 | Fujii | C22F 1/183 72/252.5 |

FOREIGN PATENT DOCUMENTS

| | | | |
|---|---|---|---|
| JP | 2001-87801 | A | 4/2001 |
| JP | 2007-332420 | A | 12/2007 |
| WO | WO 2010-090352 | A1 | 8/2010 |

* cited by examiner

METHOD FOR PRODUCING HOT-ROLLED TITANIUM PLATE

TECHNICAL FIELD

The present invention relates to a method for producing a hot-rolled titanium plate.

BACKGROUND ART

Hot-rolled titanium plates are generally produced by a production method described hereunder. First, titanium sponge obtained by the Kroll process or titanium scrap is melted, and the material is then caused to solidify to form an ingot (melting process). Next, the ingot is subjected to blooming or forging that is performed as hot processing, and is processed into a slab having a shape and dimensions suitable for hot rolling for producing a hot-rolled titanium plate (breakdown process). Next, the slab is subjected to hot rolling to form a hot-rolled titanium plate.

A non-consumable electrode arc re-melting process (VAR), an electron beam re-melting process (EBR), or a plasma arc melting process (PAM) is used as the melting method utilized in the melting process.

In the case of using the non-consumable electrode arc re-melting process as the melting method, the shape of the mold is limited to a cylindrical shape, which makes it necessary to perform a breakdown process. In the case of using the electron beam re-melting process or the plasma arc melting process as the melting method, there is a high degree of freedom with regard to the shape of the mold, since melting metal melted at a different place from the mold is poured into the mold. Consequently, a rectangular column-shaped ingot having dimensions can be cast, which is suitable for hot rolling for producing a hot-rolled titanium plate. In the case of using such kind of rectangular column-shaped ingot to produce a titanium hot-rolled material, the breakdown process can be omitted.

For example, techniques disclosed in Patent Document 1 to Patent Document 3 are available as methods for producing a hot-rolled titanium plate without performing a breakdown process.

Patent Document 1 discloses a method in which a rectangular ingot of pure titanium for which "width/thickness≥3.5" is heated to a temperature in a range of 900 to 1000° C., and after subjecting the rectangular ingot to rolling reduction in which the rolling reduction is within the range of 10% to less than 40% at a surface temperature of 880° C. or more at the start of rolling, rolling is performed so that the overall rolling reduction is 70% or more in a temperature region in which the surface temperature is less than 880° C. and the surface temperature immediately after final rolling does not become lower than 650° C. In the method disclosed in Patent Document 1, lateral spreading of the material is inhibited by suppressing the roll draft in a β-phase stable temperature region to an amount that is not greater than a specified value. By this means, according to Patent Document 1, the occurrence of a situation in which wrinkling that occurs at the surface on the hot-rolled plate side moves to the surface due to lateral spreading and become seam defects is inhibited.

In Patent Document 2, a method is proposed in which the surface of a rectangular ingot is plastically deformed as cold processing using a steel tool having a tip shape with a radius of curvature of 3 to 30 mm or a steel ball with a radius of 3 to 30 mm, and is thereby provided with dimples in which the average height of profile element of waviness is 0.2 to 1.5 mm and the average length of the profile element of waviness is 3 to 15 mm. According to Patent Document 2, by imparting strain as cold processing to the surface of the rectangular ingot by means of the steel tool or steel ball, surface defects attributable to a coarse solidified microstructure that arises when a near-surface portion is recrystallized during heating of the ingot in hot rolling are reduced.

In Patent Document 3, a titanium starting material for hot rolling is disclosed in which an outer layer of a face corresponding to a surface to be rolled of an ingot is melted and re-solidified by being subjected to one type or a combination of two or more types of processes among high-frequency induction heating, arc heating, plasma heating, electron beam heating, and laser heating, so that the microstructure in an area from the outer layer to a depth of 1 mm or more is a melted and re-solidified microstructure. According to Patent Document 3, surface defects that arise due to the influence of a coarse solidified microstructure are reduced by melting and re-solidifying the outer layer of the ingot to thereby obtain a solidified microstructure that is extremely fine and has irregular orientations.

LIST OF PRIOR ART DOCUMENTS

Patent Document

Patent Document 1: JP7-251202A
Patent Document 2: WO 2010/090352
Patent Document 3: JP2007-332420A

SUMMARY OF INVENTION

Technical Problem

However, in the conventional methods for producing a hot-rolled titanium plate, in some cases surface defects that are called "surface defects at edge portion" arise at end parts in the width direction of the surface to be rolled of the hot-rolled titanium plate. The occurrence of surface defects at edge portion is noticeable, in particular, in a hot-rolled titanium plate produced by a method that omits a breakdown process. This is because pores (pinholes) that exist in the surface of the ingot are not rendered harmless by pressure bonding in a breakdown process. Pores, if present in a titanium slab to be subjected to hot rolling, may result in surface defects at edge portion during the hot rolling because the pores present in the surface to be rolled may open at the surface, or pores present at a side surface may move around to the surface to be rolled as the result of a plastic flow caused by rolling and open at the surface to be rolled.

When surface defects at edge portion occur in a hot-rolled titanium plate, it is necessary to increase the amount of the surface of the hot-rolled titanium plate that should be removed (amount of scarfing) in a pickling process, or to cut off and remove end parts in the width direction of the surface to be rolled at which the surface defects at edge portion are present, and consequently the yield decreases.

An objective of the present invention is to provide a method for producing a hot-rolled titanium plate in which the occurrence of surface defects at edge portion is suppressed and which has favorable surface properties.

Solution to Problem

In order to suppress the occurrence of surface defects at edge portion in a hot-rolled titanium plate, the present inventors considered to inhibit pores present in a surface to be rolled of the titanium slab and in the vicinity of the surface to be rolled in side surfaces of the titanium slab from opening during hot rolling. As a result of research conducted by the present inventors, the present inventors discovered that by subjecting a titanium slab before hot working to a melting and re-solidification process that satisfies a condition in [1] hereunder and a finishing process that satisfies a condition in [2] hereunder, and performing hot working that satisfies a condition in [3] hereunder, it is possible to suppress the occurrence of surface defects at edge portion that originate from pores in the vicinity of the surface of the surface to be rolled of the titanium slab, and thus arrived at the present invention. The gist of the present invention is as follows.

(1) A method for producing a titanium plate by performing hot rolling on a titanium slab which is directly produced by using an electron beam re-melting process or a plasma arc melting process, comprising:

when a face of the titanium slab to be rolled when the slab is subjected to hot rolling is defined as a "surface to be rolled", and a face that is parallel to a rolling direction and is perpendicular to the surface to be rolled is defined as a "side surface",

[1] a step of melting at least one part on the surface to be rolled side of the side surface of the titanium slab by radiating a beam or plasma toward the side surface without radiating a beam or plasma toward the surface to be rolled, and thereafter causing re-solidification to form, in the side surface, a microstructure layer having an equivalent circular grain diameter of 1.5 mm or less and having a depth of 3.0 mm or more from the side surface;

[2] a step of performing a finishing process on the surface to be rolled of the titanium slab in which the microstructure layer is formed to bring X defined by formula (1) below to 3.0 or less; and

[3] a step of subjecting the titanium slab after the finishing process to hot rolling under a condition in which L defined by (2) below is 230 mm or more.

$$X=(\text{largest value among } H_0, H_1 \text{ and } H_2)-(\text{smallest value among } H_0, H_1 \text{ and } H_2) \quad (1)$$

$$L=\{R(H_0-H_3)\}^{1/2} \quad (2)$$

Where, the meaning of the symbols in the above formulae is as follows:

X: slab flatness index $H_0$: thickness of a central part in a width direction of the titanium slab after the finishing process (mm)

$H_1$: thickness of an end part (position at ⅛ of the width) in a width direction of the titanium slab after the finishing process (mm)

$H_2$: thickness of an end part (position at ¼ of the width) in a width direction of the titanium slab after the finishing process (mm)

L: length of arc of contact of a roll in a first pass of rough rolling (mm)

R: radius of a rolling roll in a first pass of rough rolling (mm)

$H_3$: thickness of a central part in the width direction of the titanium slab on a delivery side in a first pass of rough rolling (mm).

(2) The method for producing a hot-rolled titanium plate of (1) above, wherein, in the step of [1], the microstructure layer is formed over all of the side surface.

(3) The method for producing a hot-rolled titanium plate of (1) above, wherein, in the step of [1], in the side surface, the microstructure layer is formed in a region from the surface to be rolled to a position at at least ⅙ of the thickness of the titanium slab.

(4) The method for producing a hot-rolled titanium plate of (3) above, wherein, in the step of [1], in the side surface, the microstructure layer is formed in a region from the surface to be rolled to a position at at least ⅓ of the thickness of the titanium slab.

(5) The method for producing a hot-rolled titanium plate of any one of (1) to (4) above, wherein, in the step of [2], a surface roughness (Ra) of the surface to be rolled is made 0.6 μm or more.

(6) The method for producing a hot-rolled titanium plate of any one of (1) to (5) above, wherein, in the step of [3], the radius of the rolling roll in the first pass of rough rolling is more than 650 mm.

(7) The method for producing a hot-rolled titanium plate of any one of (1) to (6) above, wherein, in the step of [3], a rolling reduction in the first pass of rough rolling is 30% or more.

(8) The method for producing a hot-rolled titanium plate of any one of (1) to (7) above, wherein, in the step of [3], a surface roughness (Ra) of the rolling roll is 0.6 μm or more.

Advantageous Effects of Invention

According to the method for producing a hot-rolled titanium plate of the present invention, the occurrence of surface defects at edge portion which are caused by pores present in side surfaces of a titanium slab moving around to the surface to be rolled and opening at the surface to be rolled during hot rolling can be inhibited, and even if pores are present in the surface to be rolled of the titanium slab, the occurrence of surface defects at edge portion which are caused as the result of pores present in the surface to be rolled opening can be inhibited. Hence, according to the method for producing a hot-rolled titanium plate of the present invention, a hot-rolled titanium plate which has good surface properties is obtained. As a result, the amount of scarfing which is removed from the surface of a hot-rolled titanium plate in a pickling process can be reduced. Further, the width that is cut off and removed from the titanium plate at end parts in the width direction of the surface to be rolled due to surface defects at edge portion can be reduced, and the yield increases.

DESCRIPTION OF EMBODIMENTS

Figure 1:
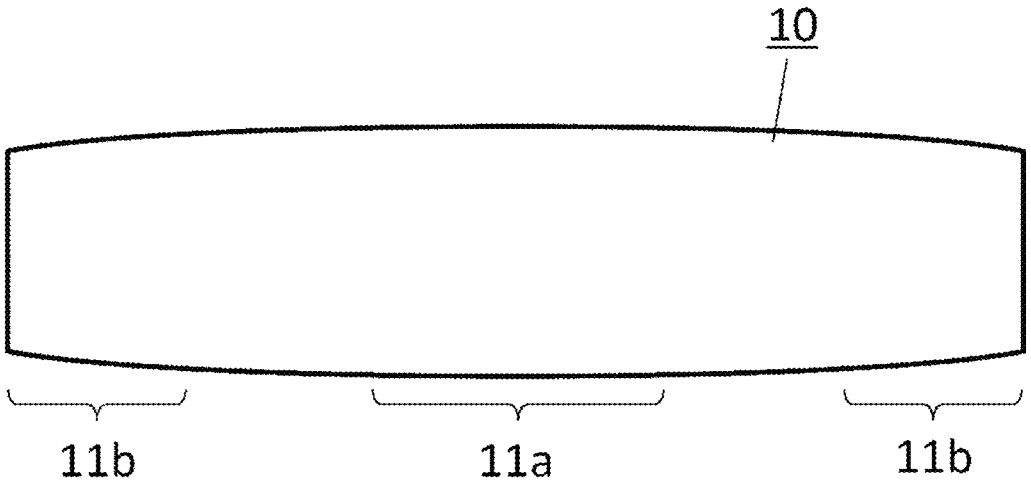
FIG. 1 is a schematic diagram illustrating a cross section of a titanium slab produced by an electron beam re-melting process or a plasma arc melting process.

In the method for producing a hot-rolled titanium plate according to the present embodiment, a titanium plate is produced by performing hot rolling after performing a melting and re-solidification process and a finishing process on a titanium slab directly produced by using an electron beam re-melting process or a plasma arc melting process. Hereunder, each of these processes will be described referring to FIG. 1 to FIG. 6.

1. Conditions for Producing Titanium Slab

When producing a hot-rolled titanium plate according to the present embodiment, a titanium slab is used directly produced by using an electron beam re-melting process or a plasma arc melting process.

In this case, as the titanium slab, a rectangular column-shaped ingot or slab having dimensions suitable for hot rolling for producing a hot-rolled titanium plate can be used, and a slab or ingot produced by using a variety of methods can be used. Specifically, a rectangular column-shaped ingot produced by using an electron beam re-melting process or a plasma arc melting process can be used as the titanium slab.

In the case of titanium having a high alloy composition, a rolling reaction force under a temperature condition of the α-phase region or the α+β-phase region is large. Therefore, it is not easy to produce a hot-rolled titanium plate having a high alloy composition that is composed only of α phase, or α phase and β phase. Accordingly, in the case of performing hot rolling of titanium having a high alloy composition with a high rolling reduction, it is preferably performed in the β-phase region. However, when titanium having a high alloy composition is subjected to hot rolling in the β-phase region, there is little occurrence of surface defects at edge portion. Therefore, the titanium slab used in the present embodiment preferably has a composition composed of titanium in which the content of Ti is 99% by mass or more (also referred to as "commercially pure titanium") or titanium having a low alloy composition in which the main constituent phase is the α phase (also referred to as "titanium alloy"). However, as necessary, titanium composed of α phase and β phase, and titanium composed of β phase may be used as the titanium slab.

The chemical composition of the titanium slab is determined according to the chemical composition and weight proportion of the titanium sponge and/or titanium scrap that is utilized as a raw material as well as the chemical compositions and weight proportions of auxiliary raw materials that are added. Therefore, to ensure that the target chemical composition of the titanium slab is obtained, the chemical compositions of the titanium sponge and titanium scrap as well as auxiliary raw materials are ascertained in advance by chemical analysis or the like, and the weights of the respective raw materials that are required are determined according to the chemical compositions. Note that, even if an element (for example, chlorine or magnesium) that is volatilized and removed by electron beam re-melting is contained in the raw material, the element is not contained in the titanium slab. Hereunder, the symbol "%" used with respect to the content of each element means "mass percent".

The chemical composition of the titanium slab of the present invention is, for example, O: 0 to 1.0%, Fe: 0 to 5.0%, Al: 0 to 5.0%, Sn: 0 to 5.0%, Zr: 0 to 5.0%, Mo: 0 to 2.5%, Ta: 0 to 2.5%, V: 0 to 2.5%, Nb: 0 to 2%, Si: 0 to 2.5%, Cr: 0 to 2.5%, Cu: 0 to 2.5%, Co: 0 to 2.5%, Ni: 0 to 2.5%, platinum group elements: 0 to 0.2%, REM: 0 to 0.1%, B: 0 to 3%, N: 0 to 1%, C: 0 to 1%, H: 0 to 0.015%, with the balance being titanium and impurities.

The platinum group elements are, specifically, one or more types of element selected from Ru, Rh, Pd, Os, Ir and Pt, and the content of platinum group elements means the total content of the aforementioned elements. Further, the term "REM" is a generic term used to refer collectively to a total of 17 elements including Sc, Y and lanthanoids, and the content of REM means the total amount of the aforementioned elements.

It is not essential for the chemical composition to contain O, Fe, Al, Sn, Zr, Mo, Ta, V, Nb, Si, Cr, Cu, Co, Ni, platinum group elements, REM and B, and the lower limit of the content of each of these elements is 0%. As necessary, the lower limit of the content of each of O, Fe, Al, Sn, Zr, Mo, Ta, V, Nb, Si, Cr, Cu, Co, Ni, platinum group elements, REM and B may be set as 0.01%, 0.05%, 0.1%, 0.2%, or 0.5%, respectively.

The upper limit of O may be set as 0.80%, 0.50%, 0.30% or 0.10%. The upper limit of Fe may be set as 3%, 2% or 1%. The upper limit of the content of Al may be set as 3%, 2% or 1%. The upper limit of the content of Sn may be set as 3%, 2% or 1%. The upper limit of the content of Zr may be set as 3%, 2% or 1%. The upper limit of the content of Mo may be set as 2%, 1.5%, 1% or 0.5%. The upper limit of the content of Ta may be set as 2%, 1.5%, 1% or 0.5%. The upper limit of the content of V may be set as 2%, 1.5%, 1% or 0.5%. The upper limit of the content of Nb may be set as 1.5%, 1%, 0.5% or 0.3%. The upper limit of the content of Si may be set as 2%, 1.5%, 1% or 0.5%. The upper limit of the content of Cr may be set as 2%, 1.5%, 1% or 0.5%. The upper limit of the content of Cu may be set as 2%, 1.5%, 1% or 0.5%. The upper limit of the content of Co may be set as 2%, 1.5%, 1% or 0.5%. The upper limit of the content of Ni may be set as 2%, 1.5%, 1% or 0.5%. The upper limit of the content of platinum group elements may be set as 0.4%, 0.3%, 0.2% or 0.1%. The upper limit of the content of REM may be set as 0.05%, 0.03% or 0.02%. The upper limit of the content of B may be set as 2%, 1%, 0.5% or 0.3%. The upper limit of the content of N may be set as 0.08%, 0.05%, 0.03% or 0.01%. The upper limit of the content of C may be set as 0.08%, 0.05%, 0.03% or 0.01%. The upper limit of the content of H may be set as 0.012%, 0.010%, 0.007% or 0.005%.

The titanium slab according to the present invention is preferably produced so as to satisfy the chemical composition range defined in various standards. Although there are also ASTM standards and AMS standards, examples of the standards will be described centering mainly on the JIS Standard as representative standards. The present invention can be used to produce titanium that conforms to the specifications of these standards.

Examples of standards for titanium include those specified for Grade 1 to Grade 4 defined in JIS H 4600 (2012), and titanium corresponding thereto that is specified for Grades 1 to 4 defined in ASTM B265 as well as 3.7025, 3.7035 and 3.7055 specified in DIN 17850.

A titanium alloy in which the total amount of alloying elements is not more than 5.0% and the balance is Ti and impurities may be mentioned as an example of titanium having a low alloy composition in which the main constituent phase is the a phase. In this case, examples of the alloying elements include Al and the like that are α stabilizing elements, Sn, Zr and the like that are neutral elements, Fe, Cr, Cu, Ni, V, Mo, Ni, Si, Co, Ta and the like that are β stabilizing elements, Pd, Ru and the like that are platinum group elements, Mm (misch metal), Y and the like that are rare earth metals, and O, C, N and the like that are gas elements. A preferable content of a stabilizing elements or neutral elements is 0 to 5.0%, respectively, and a preferable content of β stabilizing elements is 0 to 2.5%. A preferable content of rare earth metals is 0 to 0.5%, and a preferable content of gas elements such as O, C and N is 0 to 1.0%. Each of these contents refers to the total content in the case of adding a plurality of elements.

Examples of such titanium alloys include a corrosion resistant alloy that contains 0.02 to 0.2% of Pd or Ru that are platinum group elements together with Ti, or a corrosion resistant alloy that contains 0.02 to 0.2% of Pd or Ru that are platinum group elements and contains 0.001 to 0.1% of Mm or Y constituting rare earth metals together with Ti, or a heat resistant alloy that contains 0.1 to 2.5 of each of Al, Cu and Sn for which the solubility to the α phase is high.

Figure 2:
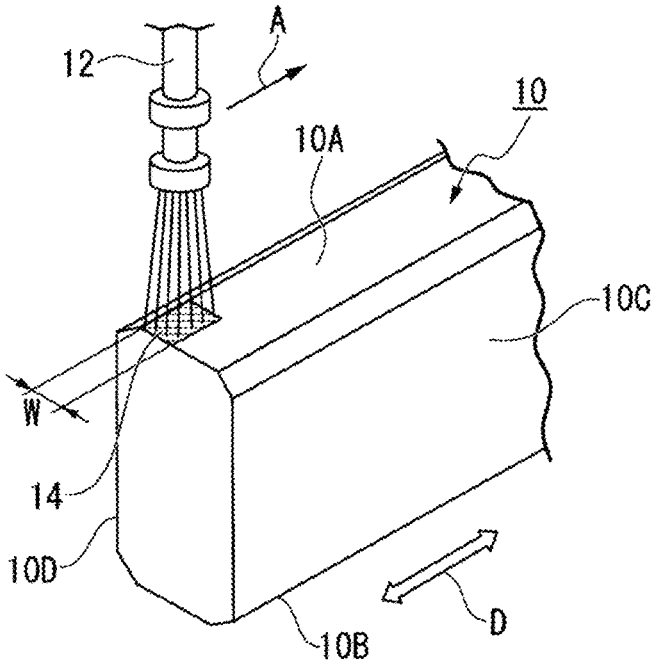
FIG. 2 is a view for describing an example of a melting and re-solidification process in a method for producing a hot-rolled titanium plate according to the present embodiment.

As illustrated in FIG. 2, a titanium slab 10 that is a starting material for a hot-rolled titanium plate is a substantially rectangular column shape. The faces that are approximately perpendicular to the thickness direction of the titanium slab 10 (in other words, the two faces at which the normal line is approximately parallel to the thickness direction of the titanium slab) are referred to as faces that are rolled 10C and 10D which are the faces that are rolled during hot rolling. As illustrated in FIG. 2, the faces that are rolled 10C and 10D of the titanium slab are approximately rectangular.

Further, faces that are approximately parallel to the thickness direction of the titanium slab 10 (in other words, faces at which the normal line is approximately perpendicular to the thickness direction of the titanium slab) are referred to as "side surfaces". The side surfaces of the titanium slab 10 are of two kinds. One kind of side surface is a side surface that is approximately parallel to the long side of a rectangle formed by the faces that are rolled 10C and 10D (in other words, a side surface at which the normal line is approximately parallel to the short side of the surface to be rolled). This kind of side surface is referred to as a "long side surface" (indicated by reference characters 10A and 10B in FIG. 2). In other words, a side surface that is parallel to a rolling direction D in the hot rolling process is a long side surface. The other kind of side surface is a side surface that is approximately parallel to the short side of a rectangle formed by the faces that are rolled 10C and 10D (in other words, a side surface at which the normal line is approximately parallel to the long side of a rectangle formed by the faces that are rolled). This kind of side surface is referred to as a "short side surface"

Note that, the side surfaces 10A and 10B that are parallel to the rolling direction D of the titanium slab 10 used in the present embodiment mean "long side surfaces". In the description hereunder, unless specifically stated otherwise, the term "side surface" of a titanium slab means a "long side surface" of the titanium slab.

2. Conditions for Melting and Re-Solidification Process

The melting and re-solidification process that is performed on the titanium slab must satisfy the condition described in [1] hereunder.

[1] After melting at least one part on the surface to be rolled side of a side surface of the titanium slab by radiating a beam or plasma toward the side surface without radiating a beam or plasma toward the surface to be rolled, the melted part is caused to re-solidify to form a microstructure layer having an equivalent circular grain diameter of 1.5 mm or less to at least at a depth of 3.0 mm from the surface of the side surface. The microstructure layer is a microstructure that is formed by transformation from β phase to α phase during melting and re-solidification and is a finer microstructure than the parent phase, and hereunder is referred to as "fine-grained microstructure layer".

Note that, because a titanium slab directly produced by using an electron beam or a plasma arc melting process is cooled slowly in vacuum, the parent phase on which a melting and re-solidification process is not performed is an extremely large cast microstructure having an equivalent circular grain diameter of several mm. On the other hand, after the side surface of such kind of titanium slab was melted temporarily by the melting and re-solidification process, the titanium slab is cooled relatively quickly by heat dissipation from the slab during re-solidification. Therefore, the fine-grained microstructure layer is a fine microstructure compared to the parent phase. The equivalent circular grain diameter of the fine-grained microstructure layer is preferably 1.2 mm or less, and more preferably is 1.0 mm or less. Although the equivalent circular grain diameter in the fine-grained microstructure layer may be as small as possible, the practical lower limit thereof is 5 μm. The lower limit of the equivalent circular grain diameter of the fine-grained microstructure layer may be 1 μm. Pores present in the side surfaces of the titanium slab can be rendered harmless by forming this kind of fine-grained microstructure layer.

Further, the grain diameter of the fine-grained microstructure layer can be measured by polishing a T cross section (cross section perpendicular to the side surface and parallel to the thickness direction of the titanium slab) of the titanium slab, and performing measurement using EBSD (Electron backscattered diffraction pattern). In the measurement, grains are regarded as being different when there is a crystal orientation difference of 5° or more between adjacent measurement points, and the area A of each grain is determined, and the equivalent circular grain diameter L can be calculated based on $A=\pi\times(L/2)^2$.

When the titanium slab is subjected to hot rolling, parts of the side surfaces moves around as far as the surface to be rolled due to lateral spreading of a central part of the titanium slab. Therefore, if defects are present on a side surface part, a large amount of surface defects at edge portion arise at the widthwise end portions of the plate, and a large part of those portions must be cut off, which causes the yield to decrease. Even in a case where the amount of movement around to the surface to be rolled is large, the amount that moves around corresponds to approximately ⅓ to ⅙ of the thickness of the slab. For example, in a case where the slab thickness is in the range of around 200 to 260 mm, the amount that moves around is about several tens of mm. Consequently, a portion that moves around to the surface to be rolled is a portion that is close to the surface to be rolled (is in the vicinity of the surface to be rolled) on the side surface, and the occurrence of surface defects at edge portion on the surface to be rolled can be suppressed even without melting and re-solidifying the entire side surface. Hence, it suffices to form the fine-grained microstructure layer at least at one part on the surface to be rolled side of each side surface. More specifically, in the case of melting and re-solidifying at least one part on the surface to be rolled side of the side surface, when the titanium slab thickness is taken as "t", it is preferable to form the fine-grained microstructure layer in a region from the surface to be rolled to a position located at ⅓ t. In other words, it is preferable to melt and re-solidify at least areas from the top end and bottom end to a position located at ⅓ t. In other words, even if there is a region which is not subjected to melting and re-solidifying below the position at ⅓ t in the center of the plate thickness, the occurrence of surface defects at edge portion on the surface to be rolled can be inhibited. Further, by subjecting only one portion of the side surface to melting and re-solidifying, the processing time can be shortened and the productivity increases. However, since there is a risk that an effect of inhibiting the occurrence of surface defects at edge portion will not be adequately obtained when a fine-grained microstructure layer is provided in only a very narrow range, in the case of providing a fine-grained microstructure layer at least at one part on the surface to be rolled side of a side surface, the fine-grained microstructure layer may be formed in a region from the surface to be rolled to a position located at ⅙ t.

On the other hand, the entire side surface may be melted and re-solidified. In this case, in addition to suppressing the occurrence of surface defects at edge portion caused by a part of the respective side surfaces moving around to the surface to be rolled as described above, the occurrence of edge cracks at end parts of the plate can be suppressed. Edge cracks lower the yield. Further, in a case where cold rolling is performed after performing hot rolling of a titanium product having a comparatively high strength, plate rupturing that originates at the edge cracks may sometimes occur. By melting and re-solidifying the entire side surface, the occurrence of such plate rupturing can be suppressed. A determination as to whether to melt and re-solidify only at least one part on the surface to be rolled side of the side surface or the entire side surface may be made based on the product size (thickness) or the production process (whether the production process includes cold rolling or the like).

In the present process, the surface to be rolled of the titanium slab is not melted. The reason is that, if melting and re-solidifying of the surface to be rolled of the titanium slab is performed, unevenness may arise on the surface. In particular, in the present invention hot rolling is performed so that the length of the arc of contact is made a long length of 230 mm or more, and hence a large plastic flow is also liable to arise in the plate width direction during hot rolling. Consequently, if the surface to be rolled is melted and re-solidified, linear hot rolling defects may arise in the surface. Therefore, in the present patent, melting and re-solidifying of the surface to be rolled is not performed.

FIG. 2 is a view for describing an example of the melting and re-solidification process in the method for producing a hot-rolled titanium plate of the present embodiment. According to the melting and re-solidification process, by radiating a beam or plasma onto the side surfaces 10A and 10B without performing a melting and re-solidification process in which a beam or plasma is radiated toward the faces that are rolled 10C and 10D, at least one part on the faces that are rolled 10C and 10D sides of the side surfaces 10A and 10B that are parallel to the rolling direction D of the titanium slab 10 are melted and re-solidified, and a microstructure that is finer than the base metal microstructure is formed. At this time, the melting and re-solidification are performed so that the depth of the fine-grained microstructure layer from the side surfaces 10A and 10B is 3.0 mm or more. In the melting and re-solidification process with respect to the side surfaces 10A and 10B, in some cases a part of the end regions of the faces that are rolled 10C and 10D (for example, regions extending to 10 mm or 5 mm from the ends) that are adjacent to the side surfaces 10A and 10B may be melted and re-solidified and a microstructure layer that is similar to the fine-grained microstructure layer may be formed, and such melting and re-solidification is acceptable.

As a heating method that is used when melting and re-solidifying the side surfaces 10A and 10B that are parallel to the rolling direction D of the titanium slab 10 in the present embodiment, arc heating (TIG (tungsten inert gas)), laser heating using a carbon dioxide gas laser or the like, plasma heating, plasma arc heating, induction heating, electron beam heating or the like can be used. In particular, in a case where plasma heating and electron beam heating are used, since the heat input can be enlarged, the unevenness of the casting surface of an as-cast rectangular column-shaped ingot can be easily smoothed. Further, in a case where plasma heating and electron beam heating are used, the melting and re-solidification process can be easily performed in a non-oxidative atmosphere. Therefore, plasma heating and electron beam heating are suitable as methods for melting and re-solidifying the titanium slab 10 that is composed of an active metal. In the case of perform the melting and re-solidification process in vacuum to inhibit oxidation of the surface of the titanium slab 10, it is desirable to make the degree of vacuum inside the furnace in which the melting and re-solidification process is performed a degree of vacuum as high as $3\times10^{-3}$ Torr or less.

The melting and re-solidification process of the present embodiment may be performed once, or the number of times that the melting and re-solidification process is performed may be increased as necessary. However, the greater that the number of times the melting and re-solidification process is performed is, the longer the processing time required for the melting and re-solidification process will be, which will lead to a decrease in productivity and an increase in cost. Therefore, the number of times that the melting and re-solidification process is performed is preferably one time or two times.

According to the present embodiment, a fine-grained microstructure layer is formed by melting and re-solidifying at least one part on the faces that are rolled 10C and 10D sides of the side surfaces 10A and 10B that are parallel to the rolling direction D of the titanium slab 10. In the titanium slab 10 having a fine-grained microstructure layer of the present embodiment, because there is a significant difference between the size of the microstructure of the fine-grained microstructure layer and the size of the microstructure of the base metal, the fine-grained microstructure layer and the base metal can be easily distinguished by performing microscopic observation of a cross section that is orthogonal to the rolling direction. The fine-grained microstructure layer includes a melting and re-solidification melted and re-solidified in the melting and re-solidification process, and a heat affected zone layer (HAZ layer) in the melting and re-solidification process.

In the present embodiment, by performing the melting and re-solidification process, a fine-grained microstructure layer is formed to a depth of 3.0 mm or more at least at one part on the faces that are rolled 10C and 10D sides of the side surfaces 10A and 10B. The depth of the fine-grained microstructure layer is preferably 4.0 mm or more. By making the depth of the fine-grained microstructure layer 3.0 mm or more, pores that exist in the side surfaces of the titanium slab 10 can be rendered harmless. Further, by making the depth of the fine-grained microstructure layer 3.0 mm or more, in a case where an as-cast rectangular column-shaped ingot is used as the titanium slab 10, the unevenness of the casting surface on the side surfaces of the titanium slab 10 can be lessened. In contrast, when the depth of the fine-grained microstructure layer is less than 3.0 mm, pores present in the side surfaces of the titanium slab 10 move around to the surface to be rolled due to a plastic flow caused by hot rolling, and the occurrence of surface defects at edge portion that arise due to the pores opening at the surface to be rolled cannot be adequately suppressed.

In order to efficiently perform the melting and re-solidification process, the depth of the fine-grained microstructure layer is preferably made 20.0 mm or less, and more preferably is made 10.0 mm or less.

In the present embodiment, the term "depth" of the fine-grained microstructure layer means a depth that is measured by the following method. A sample in which a region on a side surface at a cross section that is perpendicular to the side surface is adopted as an observation surface is taken from the titanium slab after the melting and re-solidification process. The obtained sample is embedded in a resin as necessary, the observation surface is made a mirror-finished surface by mechanical polishing, and is then subjected to etching using a nitric-hydrofluoric acid solution, and visual fields of 30×30 mm or more are observed with a microscope to measure the depth of the fine-grained microstructure layer. Note that, in a case where the fine-grained microstructure layer is deep, the visual fields are increased in the depth direction and micrographs are connected to measure the depth of the fine-grained microstructure layer. An average value is then calculated based on the depth of the fine-grained microstructure layer at arbitrary five locations, and the calculated value is adopted as the depth of the fine-grained microstructure layer.

Next, as an example of the melting and re-solidification process of the present embodiment, a case in which the side surfaces 10A and 10B that are parallel to the rolling direction D of the titanium slab 10 are melted and re-solidified using electron beam heating will be described.

First, as illustrated in FIG. 2, the titanium slab 10 is arranged so as that the side surfaces 10A and 10B are approximately horizontal. Next, among the two side surfaces 10A and 10B of the titanium slab 10, an electron beam from one electron beam radiation gun 12 as a heating apparatus is radiated onto the face that is arranged facing upward (denoted by reference character 10A in FIG. 2) to thereby heat the surface, and at least a part on the surface to be rolled 10D side of the side surface 10A is melted and re-solidified.

The shape and area of an irradiated region 14 of the electron beam with respect to the side surface 10A of the titanium slab 10 can be adjusted according to the method for adjusting the focus of the electron beam, and/or the method for forming a beam flux by using an electromagnetic lens to oscillate a small beam at a high frequency or the like.

The area of the irradiated region 14 of the electron beam on the side surface 10A of the titanium slab 10 is far smaller than the total area of the side surface 10A that is the object of melting and re-solidifying. Therefore, it is preferable to radiate the electron beam while continuously moving the electron beam radiation gun 12 with respect to the side surface 10A of the titanium slab 10, or while continuously moving the side surface 10A of the titanium slab 10 with respect to the electron beam radiation gun 12.

The direction of movement of the electron beam radiation gun 12 with respect to the side surface 10A is not particularly limited. For example, as illustrated in FIG. 2, the electron beam radiation gun 12 may radiate an electron beam while being moved (indicated by an arrow A in FIG. 2) in the rolling direction D of the titanium slab 10 (longitudinal direction of the titanium slab 10). By this means, the electron beam radiation gun 12 continuously heats the side surface 10A in a band shape with a width W (a diameter W in the case of a circular beam or a beam flux). When the electron beam radiation gun 12 reaches the end part in the longitudinal direction of the titanium slab 10, the electron beam radiation gun 12 is moved by an amount corresponding to a predetermined dimension in the thickness direction of the titanium slab 10. Subsequently, in an unheated region that is disposed next to the band-shaped heated region on the side surface 10A, the side surface 10A is heated continuously in a band shape while moving the electron beam radiation gun 12 in the opposite direction to the direction of the previous movement in the longitudinal direction.

Movement of the electron beam radiation gun 12 in the longitudinal direction of the titanium slab 10 and movement of the electron beam radiation gun 12 by an amount corresponding to a predetermined dimension in the thickness direction of the titanium slab 10 are repeatedly performed in this manner to thereby heat at least one part of, or all of, the surface to be rolled 10D side of the side surface 10A.

When the surface temperature of the side surface 10A becomes equal to or higher than the fusing point of titanium (normally about 1670° C.) as the result of heating the side surface 10A of the titanium slab 10 by radiating an electron beam thereon, the outer layer of the side surface 10A is melted. By this means, as illustrated in FIG. 3, unevenness 10P of the casting surface or defects 10Q such as pores present in the side surface 10A of the titanium slab 10 are rendered harmless.

Subsequently, when the outer layer of the side surface 10A is cooled by heat dissipation from the base metal (within the titanium slab 10) after melting and the temperature thereof becomes equal to or less than the solidification temperature, the melted outer layer of the side surface 10A solidifies and becomes a melting and re-solidification 16. Thus, in the side surface 10A, a fine-grained microstructure layer 20 composed of the melting and re-solidification 16 and a heat-affected zone layer (HAZ layer) 18 is formed to a depth that is in accordance with the heat input of the electron beam. The heat-affected zone layer (HAZ layer) 18 is formed as the result of a region on the base metal side of the melting and re-solidification 16 reaching a temperature that is not less than the β transformation point due to heating when the melting and re-solidification 16 is formed, and transforming to the β phase.

Figure 3:
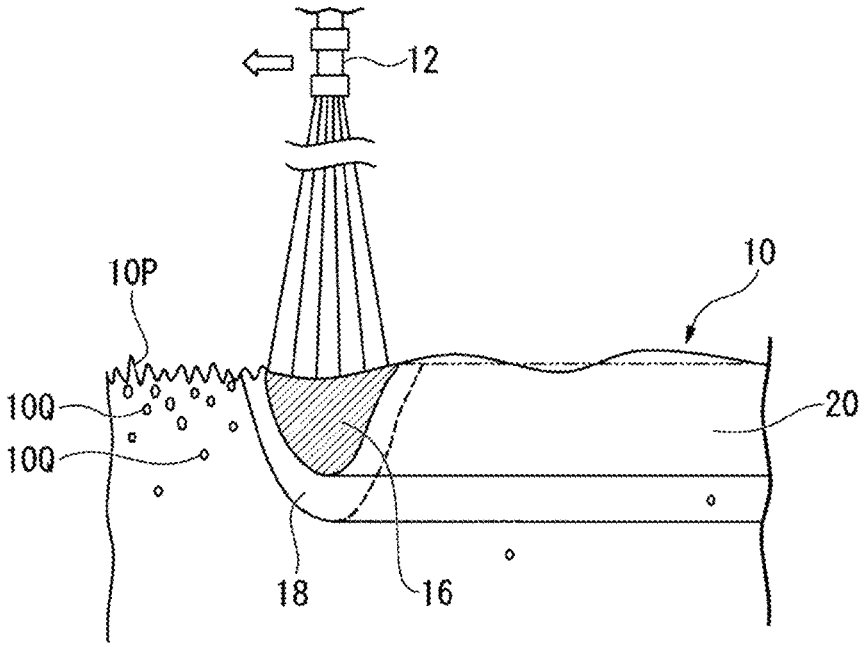
FIG. 3 is a view for describing an example of a melting and re-solidification process.
Figure 4:
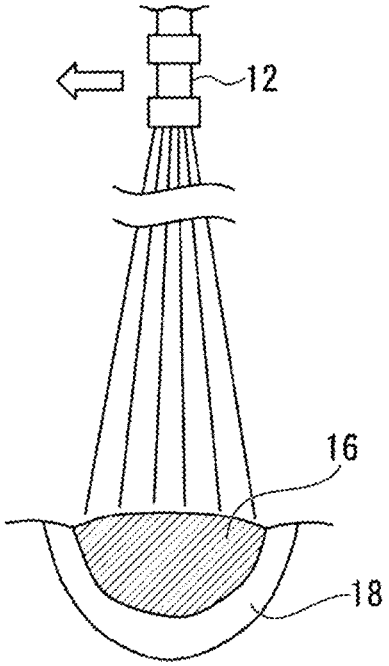
FIG. 4 is a view for describing an example of a melting and re-solidification process.

Note that, as illustrated in FIG. 3 and FIG. 4, the depth of the melting and re-solidification 16 and the heat-affected zone layer (HAZ layer) 18 that are formed using electron beam heating (depth of the fine-grained microstructure layer 20) is not uniform. In the melting and re-solidification 16 and the heat-affected zone layer (HAZ layer) 18, the depth is greatest at the central portion of the irradiated region 14 of the electron beam, and the depth becomes progressively shallower towards the edges of the irradiated region 14 so as to be a curved shape that is convex toward the base metal side in cross-sectional view. Therefore, in order to make the depth of the melting and re-solidification 16 and the heat-affected zone layer (HAZ layer) 18 (depth of the fine-grained microstructure layer 20) that are formed using electron beam heating 3.0 mm or more, in some cases it is necessary to adjust the interval of the electron beam that is radiated in a band shape.

For example, in the case of continuously heating the entire side surface by repeatedly performing movement of the electron beam radiation gun 12 in the longitudinal direction of the titanium slab and movement of the electron beam radiation gun 12 by an amount corresponding to a predetermined dimension in the thickness direction of the titanium slab 10 as described above, by making the movement of the electron beam radiation gun 12 in the thickness direction of the titanium slab 10 a movement of an amount corresponding to a dimension that is not more than ½ of the melting width, the depth of the fine-grained microstructure layer 20 can be made approximately uniform.

That is, according to the present embodiment, it is preferable to melt and re-solidify the side surface 10A in a manner in which the heat input produced by the electron beam and the radiation interval of the electron beam are controlled so that the depth of the fine-grained microstructure layer 20 becomes 3.0 mm or more. It is preferable that a difference between the maximum depth and minimum depth of the fine-grained microstructure layer 20 in each observation visual field is 1.0 mm or less.

Next, the titanium slab 10 is placed so that the side surface 10B faces upward, and an electron beam is radiated thereon from one electron beam radiation gun 12 to melt and re-solidify the surface in a similar manner to the side surface 10A.

By performing the above process, the fine-grained microstructure layer 20 having a depth of 3.0 mm or more that is composed of a finer microstructure than the base metal microstructure is formed in the side surfaces 10A and 10B that are parallel to the rolling direction D of the titanium slab 10.

3. Conditions of Finishing Process

It is necessary for the finishing process that is performed on the titanium slab after the melting and re-solidification process to satisfy the following [2].

[2] A surface to be rolled of the titanium slab in which the fine-grained microstructure layer is formed is subjected to a finishing process, and X defined by formula (1) below is brought to 3.0 or less.

$$X=(\text{largest value among } H_0, H_1 \text{ and } H_2)-(\text{smallest value among } H_0, H_1 \text{ and } H_2) \quad (1)$$

Where, the meaning of the symbols in the above formula is as follows.

X: slab flatness index $H_0$: thickness of a central part in the width direction of the titanium slab after the finishing process (mm)

$H_1$: thickness of an end part (position at ⅛ of the width) in the width direction of the titanium slab after the finishing process (mm)

$H_2$: thickness of an end part (position at ¼ of the width) in the width direction of the titanium slab after the finishing process (mm)

FIG. 1 is a schematic diagram of a cross section of a titanium slab produced by an electron beam re-melting process or a plasma arc melting process. In the electron beam re-melting process or the plasma arc melting process, a titanium slab is produced by pouring titanium melting metal into a mold and then drawing out the metal from below. At such time, when the titanium slab is inside the mold, the titanium slab has a shape that is the same as the shape of the mold because the titanium slab is restricted from four sides. However, when the titanium slab comes out from the mold, the shape of the titanium slab is no longer restricted. At such time, a melting metal pool remains at the central part of the titanium slab, and bulging occurs at the central part of the titanium slab due to a pressure from the inside to the outside. Consequently, as illustrated in FIG. 1, in the width direction the titanium slab 10 becomes a drum shape in which a central part 11*a* bulges slightly in comparison to end parts 11*b*. Therefore, if hot rolling is performed while the titanium slab 10 is that shape, the length of the arc of contact of the rolling roll will change between the central part 11*a* and the end parts 11*b*, and the length of the arc of contact at the end parts 11*b* will become short. In such a case, pores will open in the vicinity of the end parts 11*b*, and surface defects at edge portion will arise. If the maximum difference in thickness between the central part 11*a* and the end parts 11*b* is 3.0 mm or less, the length of the arc of contact can be stably secured. Hence, the flatness index X defined by formula (1) above is made 3.0 or less. The flatness index X is preferably made 2.8 or less, and more preferably is made 2.6 or less. Although it is preferable for the flatness index X to be as small as possible, when producibility is taken into consideration, 0.5 is the practical lower limit.

In the present embodiment, a method that performs a grinding process such as grinding machining and/or a cutting process such as milling or planing may be mentioned as examples of a method employed to subject the faces that are rolled 10C and 10D to a finishing process. The grinding process is distinguished from the cutting process such as milling or planing. As a finishing process, after cutting is performed, finishing may be performed by a grinding process such as grinding machining.

In the present embodiment, it is preferable to subject the faces that are rolled 10C and 10D of the titanium slab 10 having the fine-grained microstructure layer 20 to a finishing process to achieve a surface roughness (Ra) of 0.6 μm or more, and more preferably 0.8 μm or more. By making the surface roughness (Ra) of the faces that are rolled 10C and 10D 0.6 μm or more, in the hot rolling process, the force of constraint applied to the titanium slab 10 by rolling rolls that sandwich the titanium slab 10 increases, and the occurrence of surface defects at edge portion is suppressed to a greater degree. If the surface roughness Ra is too high, there is a risk that hot rolling defects will arise due to unevenness and will cause the surface properties to deteriorate. Therefore, the surface roughness Ra is preferably made 100 μm or less. A surface roughness Ra of 50 μm or less is further preferable.

4. Condition for Hot Rolling

It is necessary for hot rolling that is performed on the titanium slab after the finishing process to satisfy the condition described in the following [3].

[3] Hot rolling of the titanium slab after the finishing process is performed under a condition in which L defined in the following (2) is 230 mm or more.

$$L=\{R(H_0-H_3)\}^{1/2} \quad (2)$$

Where, the meaning of the symbols in the above formulae is as follows.

L: length of the arc of contact of the roll in first pass of rough rolling (mm)

R: radius of rolling roll in the first pass of rough rolling (mm)

$H_0$: thickness of a central part in the width direction of the titanium slab after the finishing process (mm)

$H_3$: thickness of a central part in the width direction of the titanium slab on the delivery side in the first pass of rough rolling (mm)

In this case, in the first pass of rough rolling, the area of contact between the rolling rolls and the titanium slab is sufficiently secured. Hence, the force of constraint applied to the titanium slab by the rolling rolls that sandwich the titanium slab is sufficiently obtained. As a result, even if pores are present in the surface to be rolled of the titanium slab, opening of the pores present in the surface to be rolled is inhibited, and the occurrence of surface defects at edge portion is suppressed.

The method for producing a hot-rolled titanium plate according to the present invention will now be described in further detail.

The method of hot rolling employed in the hot rolling process is not particularly limited, and a method that is known in the art can be used, and in a case where a hot-rolled titanium plate is to be made into a thin-sheet product, usually coil rolling is employed. Further, in the case of making a thin-sheet product, the plate thickness of the hot-rolled titanium plate is usually approximately 3 mm to 8 mm.

Conditions that are known in the art can be adopted as the heating conditions in the hot rolling process. For example, similarly to the usual titanium hot rolling, it suffices to perform heating to a temperature within the range of 720 to 920° C. for 60 to 420 minutes, and to start hot rolling within the temperature range, and to finish the hot rolling at a temperature that is equal to or higher than room temperature in accordance with the performance of the hot rolling mill.

Figure 5:
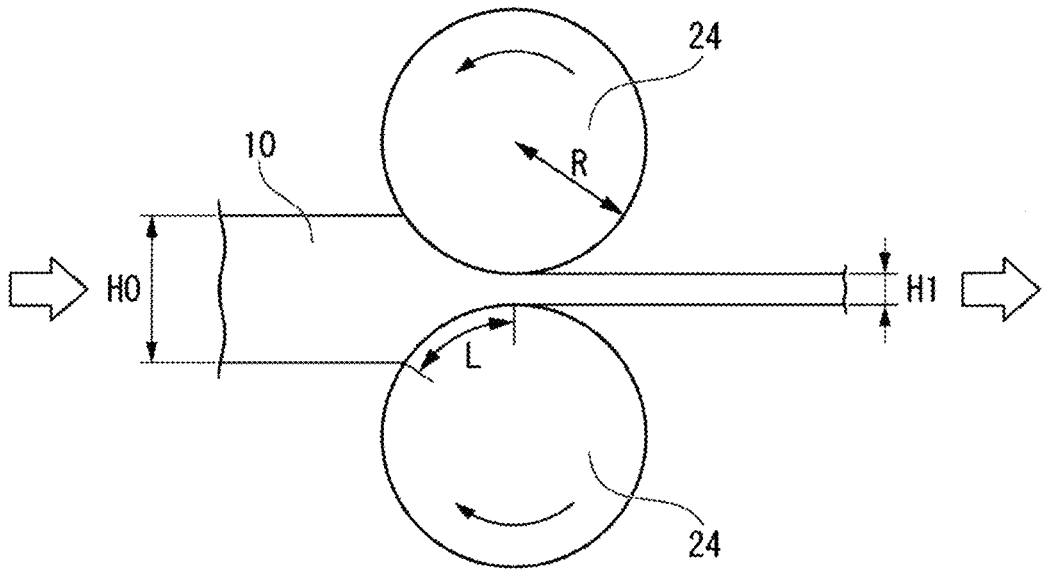
FIG. 5 is a view for describing an example of a hot rolling process in the method for producing a hot-rolled titanium plate according to the present embodiment.

FIG. 5 is a view for describing an example of the hot rolling process in the method for producing a hot-rolled titanium plate of the present embodiment. FIG. 5 is a schematic cross-sectional view illustrating a state in which the titanium slab 10 having the fine-grained microstructure layer 20 is being rolled by rolling rolls 24, 24 of a rolling mill in a roll bite in a first pass of rough rolling. In the hot rolling process of the present embodiment, hot rolling for the first pass of rough rolling of the titanium slab 10 having the fine-grained microstructure layer 20 is performed in which the length of the arc of contact of the roll L for each roll is 230 mm or more.

The length of the arc of contact of the roll L is the length of a portion at which each rolling roll 24 and the titanium slab 10 come in contact when the rolling rolls 24, 24 of the rolling mill are viewed in cross section, and is represented by the above formula (2).

Surface defects at edge portion of the hot-rolled titanium plate arise as the result of the titanium slab 10 protruding to the side surfaces due to hot rolling. Accordingly, surface defects at edge portion are liable to arise in the initial stage of rough rolling in which the rolling reduction is large. In particular, surface defects at edge portion are liable to arise in the first pass of rough rolling, and almost no surface defects at edge portion arise in the second pass and thereafter. Therefore, it suffices to make the length of the arc of contact of the roll L 230 mm or more in only the first pass of rough rolling.

By performing hot rolling in the first pass of rough rolling of the titanium slab 10 in which the length of the arc of contact of the roll L is made 230 mm or more, a sufficient contact area is secured between the rolling rolls 24, 24 and the titanium slab 10. Hence, the force of constraint applied to the titanium slab 10 by the rolling rolls 24, 24 that sandwich the titanium slab 10 is adequately obtained, and unevenness that arises in the faces that are rolled 10C and 10D can be lessened. As a result, even if pores are present in the faces that are rolled 10C and 10D of the titanium slab 10, the pores present in the faces that are rolled 10C and 10D are inhibited from opening, and the occurrence of surface defects at edge portion is suppressed. The length of the arc of contact of the roll L is more preferably made 250 mm or more in order to increase the force of constraint applied to the titanium slab 10 by the rolling rolls 24, 24. Further, if the length of the arc of contact of the roll L is too large, the load per unit area will decrease, and the force of constraint will weaken. Therefore, the length of the arc of contact of the roll L is preferably 400 mm or less.

As shown in formula (2) above, the length of the arc of contact of the roll L is lengthened by increasing the radius R of the rolling rolls and the rolling reduction.

In order to secure the length of the arc of contact of the roll L, the radius R of the rolling roll 24 is preferably more than 650 mm, and more preferably is 750 mm or more. However, if the radius R of the rolling roll 24 is too large, large-scale rolling equipment will be required, and thus the radius R of the rolling roll 24 is preferably not more than 1200 mm.

The rolling reduction in the first pass of rough rolling is preferably set as 30% or more, more preferably 35% or more, and further preferably is 40% or more. By making the rolling reduction in the first pass of rough rolling 30% or more, it is easy to secure the length of the arc of contact of the roll L, and opening of pores present in the vicinity of the faces that are rolled 10C and 10D of the titanium slab 10 is suppressed, and the occurrence of surface defects at edge portion is suppressed even more. However, in order to make the rolling reduction in the first pass of rough rolling more than 50%, it is necessary to use rolling equipment that can apply a large load, and consequently the scale of the rolling equipment will be large. Therefore, the rolling reduction in the first pass of rough rolling is preferably set to not more than 50%.

The surface roughness (Ra) of the rolling roll 24 is preferably 0.6 μm or more, and more preferably is 0.8 μm or more. When the surface roughness (Ra) of the rolling roll 24 is 0.6 μm or more, the force of constraint applied to the titanium slab 10 by the rolling rolls 24, 24 that sandwich the titanium slab 10 increases, and the occurrence surface defects at edge portion is suppressed even more. However, if the surface roughness (Ra) of the rolling roll 24 is too high, in some cases the surface properties of the hot-rolled plate may deteriorate. Therefore, the surface roughness (Ra) of the rolling roll 24 is preferably 1.5 μm or less.

In the method for producing a hot-rolled titanium plate of the present embodiment, because the fine-grained microstructure layer 20 having a depth of 3.0 mm or more is formed in the side surfaces 10A and 10B by melting and re-solidifying the side surfaces 10A and 10B that are parallel to the rolling direction D of the titanium slab 10, pores present in the side surfaces 10A and 10B of the titanium slab 10 can be rendered harmless. Accordingly, the occurrence of surface defects at edge portion that are caused by pores which are present in the side surfaces 10A and 10B of the titanium slab 10 moving around to the faces that are rolled 10C and 10D during hot rolling and opening at the faces that are rolled 10C and 10D can be suppressed.

Further, in the method for producing a hot-rolled titanium plate of the present embodiment, hot rolling in the first pass of rough rolling of the titanium slab 10 having the fine-grained microstructure layer 20 is performed in which the length of the arc of contact of the roll L is made 230 mm or more. Therefore, a force of constraint applied to the titanium slab 10 by the rolling rolls 24, 24 which sandwich the titanium slab 10 is sufficiently obtained. As a result, even if pores are present in the faces that are rolled 10C and 10D of the titanium slab 10, opening of the pores present in the faces that are rolled 10C and 10D is inhibited, and the occurrence of surface defects at edge portion is suppressed.

Hence, according to the method for producing a hot-rolled titanium plate of the present embodiment, a hot-rolled titanium plate that has good surface properties is obtained. As a result, in a case where the hot-rolled titanium plate is subjected to pickling, the amount of scarfing removed from the surface can be reduced. Further, in a case where end parts in the width direction of the surface to be rolled that are caused by surface defects at edge portion are cut off and removed from the hot-rolled titanium plate, the width that is cut off and removed from the titanium plate can be reduced. Accordingly, the yield of the material that is used for the hot-rolled titanium plate increases.

Further, according to the method for producing a hot-rolled titanium plate of the present embodiment, because a hot-rolled titanium plate having good surface properties is obtained even if production is performed in a manner that omits a breakdown process, a breakdown process may be omitted and the productivity can thereby be improved. Furthermore, in the method for producing a hot-rolled titanium plate of the present embodiment, even when an as-cast rectangular column-shaped ingot is used as the titanium slab 10, the unevenness 10P on the casting surface of the side surfaces 10A and 10B of the titanium slab 10 can be lessened by performing a melting and re-solidification process. Hence, it is not necessary to perform a process for smoothing the casting surface of the side surfaces 10A and 10B of the titanium slab 10 separately from the melting and re-solidification process.

Thus, the method for producing a hot-rolled titanium plate of the present embodiment is extremely useful for reducing production costs, and the industrial effects are immeasurable.

Note that, the method for producing a hot-rolled titanium plate of the present invention is not limited to the production method of the above embodiment.

Figure 6:
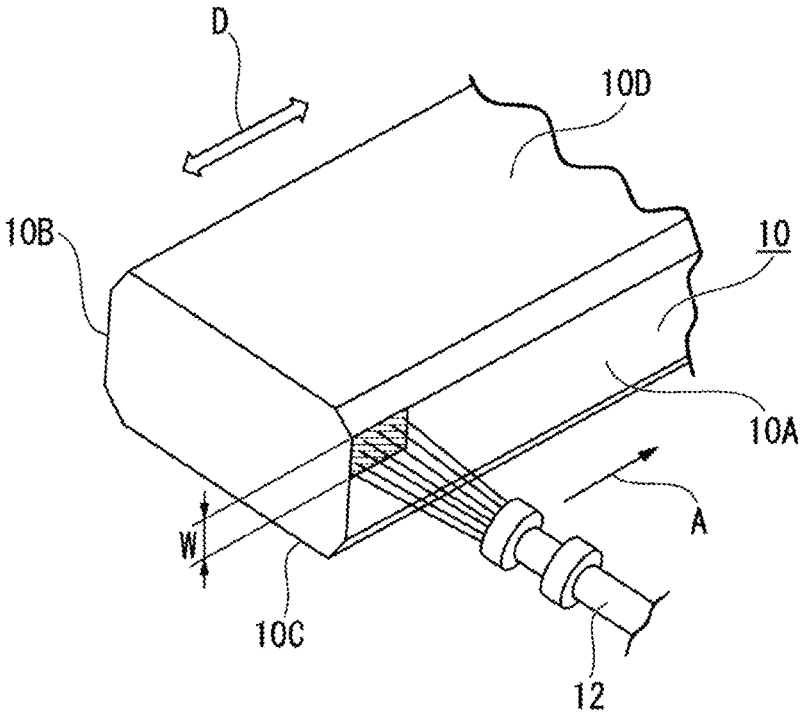
FIG. 6 is a view for describing another example of a melting and re-solidification process in the method for producing a hot-rolled titanium plate according to the present embodiment.

For example, although the above embodiment is described by taking as an example a case where the side surfaces 10A and 10B of the titanium slab 10 are arranged so as to be approximately horizontal and are then subjected to melting and re-solidifying, as illustrated in FIG. 6 a method may also be adopted in which the side surfaces 10A and 10B of the titanium slab 10 are arranged so as to be approximately perpendicular to the ground surface and are then subjected to melting and re-solidifying.

Although in the above embodiment an example is described of a case where the electron beam radiation gun 12 radiates an electron beam while being moved in the rolling direction D of the titanium slab 10 (longitudinal direction of the titanium slab 10), the electron beam radiation gun 12 may radiate an electron beam while being continuously moved along a direction (thickness direction of the titanium slab 10) that is orthogonal to the rolling direction D.

Although in the above embodiment an example is described of a case where an electron beam is radiated onto the side surfaces 10A and 10B of the titanium slab 10 using one electron beam radiation gun 12 as a heating apparatus, one or a plurality of heating apparatuses may be used, and a plurality of regions may be heated simultaneously using a plurality of heating apparatuses.

EXAMPLES

Hereunder, the present invention will be described specifically by way of examples.

Titanium materials having various chemical compositions that are shown in Table 1, Table 4 and Table 7 were melted by an electron beam re-melting process (EBM) or a plasma arc melting process (PAM) and then solidified to produce as-cast rectangular column-shaped ingots, which were adopted as titanium slabs (width of 1000 mm). Next, a melting and re-solidification process was performed under various conditions on the side surfaces (faces parallel to the rolling direction and perpendicular to the faces that are rolled) of the titanium slabs. Thereafter, a finishing process was performed under various conditions, and the titanium slabs were hot rolled to obtain titanium hot-rolled plates.

In the above melting and re-solidification process, heating of each side surface was performed by the respective methods described hereunder. The side surface was continuously heated in a band shape while moving the heating apparatus in the longitudinal direction of the titanium slab. Upon reaching an end part in the longitudinal direction of the titanium slab, the heating apparatus was moved in the thickness direction of the titanium slab by an amount corresponding to a dimension equivalent to one-half of the melting width. Subsequently, in an unheated region disposed next to the band-shaped heated region on the side surface, the side surface was heated continuously in a band shape while moving the heating apparatus in the opposite direction to the direction of the previous movement in the longitudinal direction. By repeatedly performing movement of the heating apparatus in the longitudinal direction of the titanium slab and movement of the heating apparatus in the thickness direction of the titanium slab by an amount corresponding to a dimension equivalent to one-half of the melting width in this manner, a prescribed region of the side surface (the entire side surface or one part on the rolling surface side thereof) was heated.

The titanium slabs after the melting and re-solidification process were each cut in a direction orthogonal to the rolling direction at a position that was 200 mm from the end in the rolling direction (portion corresponding to the rear end during hot rolling), and samples were extracted in which a cut cross section orthogonal to the rolling direction was taken as the observation surface. The obtained sample was embedded in resin, the observation surface was made a mirror-finished surface by mechanical polishing, and was then subjected to etching using a nitric-hydrofluoric acid solution, and visual fields of 30×30 mm or more were observed with a microscope. As a result, for all of the titanium slabs it was confirmed that a fine-grained microstructure layer composed of a microstructure that was finer than the base metal microstructure was formed at least at one part on a surface to be rolled side of the side surface. Further, the observation surface of each sample was polished, and the depth and equivalent circular grain diameter of the fine-grained microstructure layer was measured using EBSD (Electron backscattered diffraction pattern). Measurement of the equivalent circular grain diameter was performed by regarding grains as being different when there was a crystal orientation difference of 5° or more between adjacent measurement points, and determining the area A of each grain, and calculating the equivalent circular grain diameter L based on $A=\pi\times(L/2)^2$. Average values were then calculated based on the depth and equivalent circular grain diameter of the fine-grained microstructure layer at arbitrary five locations, and the calculated values were adopted as the depth and equivalent circular grain diameter of the fine-grained microstructure layer.

Next, the faces that are rolled of the titanium slab after the melting and re-solidification process were subjected to finishing by a finishing process method (grinding process (grinding machining) or cutting (milling)) to make the thickness 200 to 300 mm. Thereafter, the surface roughness (Ra) was measured at arbitrary five locations on the rolling surfaces of the titanium slab using a surface roughness tester, and the average value thereof was determined. Further, the thickness at a central part in the width direction and at end parts of the titanium slab after the finishing process was measured, and a slab flatness index was determined.

Next, the obtained titanium slabs after the finishing process were heated for 240 minutes at a temperature of 820° C., and thereafter hot rolling was performed that included rough rolling under various conditions to thereby produce hot-rolled titanium plates (strip coils).

The surface roughness (Ra) of each rolling roll was determined by the following method. The surface roughness (Ra) at arbitrary five locations on the surface of the rolling roll was measured using a surface roughness tester, and the average value of the obtained values was determined. The rolling reduction of the first pass of rough rolling was calculated based on the original plate thickness and the plate thickness after rolling in the first pass of rough rolling. The length of the arc of contact of the roll in the first pass of rough rolling was calculated using formula (2) based on the radius of the rolling rolls, the original plate thickness, and the plate thickness after rolling in the first pass of rough rolling.

Next, the strip coil was passed through a continuous pickling line composed of nitric-hydrofluoric acid, and approximately 50 μm per side was removed by scarfing. Thereafter, the end parts in the width direction of the rolling surfaces of the strip coil was subjected to visual observation to check for surface defects, and the degree of surface defects at edge portion was evaluated for the overall length of the strip coil according to the following criteria.

Minor (Evaluation A): Surface defects at edge portion could not be seen, or surface defects at edge portion of less than 5 mm were observed. (Evaluation: Good)

Somewhat large defects (Evaluation B): Surface defects at edge portion of 5 mm or more and less than 10 mm were observed. (Evaluation: Good)

Deep defects (Evaluation C): Surface defects at edge portion of 10 mm or more were observed. (Evaluation: Not Good)

The production conditions and evaluation for the starting materials for hot rolling shown in Table 1 are shown in Table 2 and Table 3, the production conditions and evaluation for the starting materials for hot rolling shown in Table 4 are shown in Table 5 and Table 6, and the production conditions and evaluation for the starting materials for hot rolling shown in Table 7 are shown in Table 8 and Table 9.

TABLE 1

| Starting Material for Hot Rolling | | | | | | | |
|---|---|---|---|---|---|---|---|
| | Ingot Production | Chemical Composition (mass %) | | | | | |
| No. | Method | O | Fe | N | C | H | Ti |
| 1 | EBM | 0.052 | 0.024 | 0.0032 | 0.0049 | 0.0044 | Bal. |
| 2 | EBM | 0.060 | 0.036 | 0.0021 | 0.0039 | 0.0028 | Bal. |
| 3 | EBM | 0.054 | 0.046 | 0.0026 | 0.0041 | 0.0027 | Bal. |
| 4 | EBM | 0.054 | 0.026 | 0.0038 | 0.0025 | 0.0046 | Bal. |
| 5 | EBM | 0.053 | 0.034 | 0.0040 | 0.0037 | 0.0030 | Bal. |
| 6 | EBM | 0.052 | 0.047 | 0.0036 | 0.0038 | 0.0029 | Bal. |
| 7 | EBM | 0.057 | 0.048 | 0.0036 | 0.0027 | 0.0056 | Bal. |
| 8 | EBM | 0.057 | 0.038 | 0.0030 | 0.0025 | 0.0021 | Bal. |
| 9 | EBM | 0.035 | 0.042 | 0.0031 | 0.0044 | 0.0041 | Bal. |
| 10 | EBM | 0.046 | 0.060 | 0.0033 | 0.0026 | 0.0050 | Bal. |
| 11 | EBM | 0.041 | 0.043 | 0.0033 | 0.0033 | 0.0037 | Bal. |
| 12 | EBM | 0.044 | 0.049 | 0.0029 | 0.0027 | 0.0055 | Bal. |
| 13 | EBM | 0.043 | 0.056 | 0.0022 | 0.0033 | 0.0050 | Bal. |
| 14 | EBM | 0.048 | 0.038 | 0.0039 | 0.0045 | 0.0033 | Bal. |
| 15 | EBM | 0.046 | 0.021 | 0.0037 | 0.0022 | 0.0044 | Bal. |
| 16 | EBM | 0.042 | 0.051 | 0.0032 | 0.0042 | 0.0042 | Bal. |
| 17 | EBM | 0.057 | 0.022 | 0.0021 | 0.0035 | 0.0040 | Bal. |
| 18 | EBM | 0.055 | 0.056 | 0.0033 | 0.0021 | 0.0056 | Bal. |
| 19 | EBM | 0.041 | 0.021 | 0.0028 | 0.0026 | 0.0021 | Bal. |
| 20 | EBM | 0.048 | 0.041 | 0.0021 | 0.0038 | 0.0059 | Bal. |
| 21 | EBM | 0.092 | 0.058 | 0.0033 | 0.0035 | 0.0030 | Bal. |
| 22 | EBM | 0.193 | 0.085 | 0.0025 | 0.0041 | 0.0029 | Bal. |
| 23 | EBM | 0.322 | 0.185 | 0.0090 | 0.0090 | 0.0045 | Bal. |
| 24 | EBM | 0.050 | 0.030 | 0.0034 | 0.0045 | 0.0020 | Bal. |
| 25 | EBM | 0.047 | 0.026 | 0.0026 | 0.0038 | 0.0040 | Bal. |
| 26 | EBM | 0.054 | 0.030 | 0.0020 | 0.0020 | 0.0045 | Bal. |
| 27 | EBM | 0.054 | 0.044 | 0.0025 | 0.0042 | 0.0037 | Bal. |
| 28 | EBM | 0.375 | 0.045 | 0.0250 | 0.0042 | 0.0037 | Bal. |
| 29 | EBM | 0.039 | 0.032 | 0.0480 | 0.0041 | 0.0029 | Bal. |
| 30 | EBM | 0.185 | 0.085 | 0.0025 | 0.0920 | 0.0029 | Bal. |
| 31 | EBM | 0.122 | 0.085 | 0.0025 | 0.0041 | 0.0115 | Bal. |
| 32 | EBM | 0.150 | 0.365 | 0.0090 | 0.0090 | 0.0045 | Bal. |
| 33 | EBM | 0.045 | 0.044 | 0.0033 | 0.0035 | 0.0030 | Bal. |
| 34 | EBM | 0.045 | 0.044 | 0.0033 | 0.0035 | 0.0030 | Bal. |
| 35 | EBM | 0.095 | 0.065 | 0.0025 | 0.0041 | 0.0029 | Bal. |

TABLE 2

| Melting and Re-solidification Process | | | | | Finishing Process | | |
|---|---|---|---|---|---|---|---|
| No. | Heating Method | Depth of Fine-grained Microstructure Layer (mm) | Equivalent Circular Gain Diameter of Fine-grained Microstructure Layer (mm) | Melting Region of Side Surfaces | Method | Surface Roughness Ra (μm) | Flatness Index X (mm) |
| 1 | Electron Beam | 2.0 | 0.20 | One Part (to ¼t) | Milling Cutter | 0.6 | 3.0 |
| 2 | Electron Beam | 2.5 | 0.22 | One Part (to ¼t) | Milling Cutter | 0.6 | 3.0 |
| 3 | Electron Beam | 3.0 | 0.25 | Entire Surface | Milling Cutter | 0.6 | 3.0 |
| 4 | Electron Beam | 14.0 | 1.60 | Entire Surface | Milling Cutter | 1.0 | 3.0 |
| 5 | Electron Beam | 11.5 | 1.30 | Entire Surface | Milling Cutter | 1.0 | 3.0 |
| 6 | Electron Beam | 10.3 | 1.10 | Entire Surface | Milling Cutter | 1.0 | 3.0 |
| 7 | Electron Beam | 5.0 | 0.30 | One Part (to ⅓ t) | Grinder | 30.0 | 3.0 |
| 8 | Electron Beam | 5.0 | 0.30 | One Part (to ⅓ t) | Grinder | 30.0 | 4.0 |
| 9 | Electron Beam | 4.0 | 0.27 | Entire Surface | Grinder | 23.0 | 3.0 |
| 10 | Electron Beam | 5.0 | 0.30 | Entire Surface | Grinder | 23.0 | 3.0 |
| 11 | Electron Beam | 5.0 | 0.30 | Entire Surface | Grinder | 25.0 | 2.5 |
| 12 | Electron Beam | 6.0 | 0.75 | Entire Surface | Grinder | 24.0 | 2.0 |
| 13 | Electron Beam | 3.0 | 0.25 | Entire Surface | Grinder | 22.0 | 1.8 |
| 14 | Electron Beam | 5.0 | 0.30 | Entire Surface | Grinder | 23.0 | 1.5 |
| 15 | Electron Beam | 5.0 | 0.30 | Entire Surface | Planer | 11.0 | 1.5 |
| 16 | Electron Beam | 6.0 | 0.35 | Entire Surface | Planer | 15.0 | 3.0 |

TABLE 2-continued

| | Melting and Re-solidification Process | | | | Finishing Process | | |
|---|---|---|---|---|---|---|---|
| No. | Heating Method | Depth of Fine-grained Microstructure Layer (mm) | Equivalent Circular Gain Diameter of Fine-grained Microstructure Layer (mm) | Melting Region of Side Surfaces | Method | Surface Roughness Ra (μm) | Flatness Index X (mm) |
| 17 | Electron Beam | 3.0 | 0.25 | Entire Surface | Planer | 19.0 | 1.5 |
| 18 | Electron Beam | 5.0 | 0.30 | One Part (to ⅓ t) | Milling Cutter | 15.0 | 2.2 |
| 19 | Electron Beam | 6.0 | 0.35 | One Part (to ⅓ t) | Milling Cutter | 5.0 | 2.5 |
| 20 | Electron Beam | 3.0 | 0.20 | One Part (to ⅙ t) | Milling Cutter | 10.0 | 1.0 |
| 21 | Electron Beam | 5.0 | 0.30 | One Part (to ⅓ t) | Milling Cutter | 10.0 | 1.0 |
| 22 | Electron Beam | 6.0 | 0.35 | One Part (to ⅙ t) | Milling Cutter | 8.0 | 2.5 |
| 23 | Electron Beam | 3.0 | 0.10 | One Part (to ⅓ t) | Milling Cutter | 15.0 | 2.5 |
| 24 | Electron Beam | 6.0 | 0.35 | One Part (to ⅓ t) | Grinder | 20.0 | 1.5 |
| 25 | Plasma Arc | 5.0 | 0.45 | One Part (to ⅓ t) | Grinder | 14.0 | 2.3 |
| 26 | Laser | 4.0 | 0.35 | One Part (to ⅓ t) | Grinder | 85.0 | 0.5 |
| 27 | TIG | 4.0 | 0.40 | One Part (to ⅓ t) | Grinder | 45.0 | 2.1 |
| 28 | Electron Beam | 5.0 | 0.25 | Entire Surface | Grinder | 20.0 | 1.0 |
| 29 | Electron Beam | 6.0 | 0.30 | Entire Surface | Grinder | 25.0 | 1.0 |
| 30 | Electron Beam | 6.0 | 0.20 | Entire Surface | Grinder | 23.0 | 1.0 |
| 31 | Electron Beam | 6.0 | 0.15 | Entire Surface | Grinder | 18.0 | 1.0 |
| 32 | Electron Beam | 3.0 | 0.05 | Entire Surface | Grinder | 18.0 | 1.0 |
| 33 | Electron Beam | 5.0 | 0.30 | One Part (to ⅓ t) | Milling Cutter | 10.0 | 1.5 |
| 34 | Electron Beam | 5.0 | 0.30 | One Part (to ⅙ t) | Milling Cutter | 10.0 | 1.5 |
| 35 | Electron Beam | 6.0 | 0.35 | One Part (to ⅓ t) | Grinder | 25.0 | 1.5 |

TABLE 3

| | First pass of rough rolling | | | | | | | |
|---|---|---|---|---|---|---|---|---|
| No. | Roll Surface Roughness Ra (μm) | Roll Radius (mm) | Original Plate Thickness (mm) | Plate Thickness After Rolling (mm) | Rolling Reduction (%) | Length of Arc of Contact of Roll (mm) | Evaluation of Surface Defects after Pickling of Hot-rolled Plate (defects in vicinity of edges) | Remarks |
| 1 | 0.6 | 700 | 220 | 144 | 35 | 231 | C | Comparative Example |
| 2 | 0.6 | 700 | 220 | 144 | 45 | 231 | C | Comparative Example |
| 3 | 0.6 | 700 | 220 | 144 | 35 | 231 | B | Example |
| 4 | 0.6 | 700 | 220 | 144 | 35 | 231 | C | Comparative Example |
| 5 | 0.6 | 700 | 220 | 144 | 35 | 231 | B | Example |
| 6 | 0.6 | 700 | 220 | 144 | 35 | 231 | B | Example |
| 7 | 0.6 | 700 | 220 | 144 | 35 | 231 | B | Example |
| 8 | 0.6 | 700 | 220 | 144 | 35 | 231 | C | Comparative Example |
| 9 | 0.6 | 700 | 200 | 130 | 35 | 221 | C | Comparative Example |
| 10 | 0.7 | 700 | 200 | 150 | 25 | 187 | C | Comparative Example |
| 11 | 0.6 | 750 | 240 | 150 | 38 | 260 | A | Example |
| 12 | 0.6 | 850 | 260 | 155 | 40 | 299 | B | Example |
| 13 | 0.6 | 1100 | 200 | 150 | 25 | 235 | B | Example |
| 14 | 0.6 | 680 | 240 | 135 | 44 | 267 | B | Example |
| 15 | 0.6 | 750 | 240 | 140 | 42 | 274 | A | Example |
| 16 | 0.6 | 800 | 260 | 160 | 38 | 283 | B | Example |
| 17 | 0.6 | 800 | 200 | 120 | 40 | 253 | A | Example |
| 18 | 0.6 | 800 | 240 | 140 | 42 | 283 | A | Example |
| 19 | 0.4 | 800 | 260 | 155 | 40 | 290 | B | Example |
| 20 | 1.3 | 800 | 200 | 130 | 35 | 237 | B | Example |
| 21 | 0.6 | 750 | 220 | 140 | 36 | 245 | A | Example |
| 22 | 0.8 | 700 | 200 | 120 | 40 | 237 | B | Example |
| 23 | 0.8 | 700 | 200 | 120 | 40 | 237 | B | Example |
| 24 | 1.0 | 800 | 240 | 140 | 42 | 283 | A | Example |
| 25 | 0.6 | 700 | 200 | 120 | 40 | 237 | A | Example |

TABLE 3-continued

| No. | First pass of rough rolling: Roll Surface Roughness Ra (μm) | Roll Radius (mm) | Original Plate Thickness (mm) | Plate Thickness After Rolling (mm) | Rolling Reduction (%) | Length of Arc of Contact of Roll (mm) | Evaluation of Surface Defects after Pickling of Hot-rolled Plate (defects in vicinity of edges) | Remarks |
|---|---|---|---|---|---|---|---|---|
| 26 | 0.6 | 700 | 200 | 120 | 40 | 237 | B | Example |
| 27 | 0.6 | 700 | 200 | 120 | 40 | 237 | B | Example |
| 28 | 0.6 | 750 | 200 | 125 | 38 | 237 | B | Example |
| 29 | 0.6 | 750 | 200 | 125 | 38 | 237 | B | Example |
| 30 | 0.6 | 750 | 200 | 125 | 38 | 237 | B | Example |
| 31 | 0.6 | 750 | 200 | 125 | 38 | 237 | B | Example |
| 32 | 0.6 | 750 | 200 | 125 | 38 | 237 | B | Example |
| 33 | 0.6 | 550 | 220 | 120 | 45 | 235 | B | Example |
| 34 | 0.4 | 700 | 220 | 140 | 36 | 237 | B | Example |
| 35 | 0.4 | 550 | 220 | 120 | 45 | 235 | B | Example |

TABLE 4

| No. | Starting Material for Hot Rolling: Ingot Production Method | Chemical Composition (mass %): O | Fe | N | C | H | Ti |
|---|---|---|---|---|---|---|---|
| 36 | PAM | 0.053 | 0.044 | 0.0023 | 0.0037 | 0.0022 | Bal. |
| 37 | PAM | 0.133 | 0.047 | 0.0032 | 0.0020 | 0.0027 | Bal. |
| 38 | PAM | 0.265 | 0.122 | 0.0550 | 0.0045 | 0.0027 | Bal. |
| 39 | PAM | 0.345 | 0.275 | 0.0045 | 0.0055 | 0.0036 | Bal. |

TABLE 4-continued

| No. | Starting Material for Hot Rolling: Ingot Production Method | Chemical Composition (mass %): O | Fe | N | C | H | Ti |
|---|---|---|---|---|---|---|---|
| 40 | PAM | 0.045 | 0.040 | 0.0034 | 0.0038 | 0.0028 | Bal. |
| 41 | PAM | 0.052 | 0.026 | 0.0024 | 0.0028 | 0.0059 | Bal. |
| 42 | PAM | 0.050 | 0.021 | 0.0034 | 0.0047 | 0.0060 | Bal. |

TABLE 5

| No. | Melting and Re-solidification Process: Heating Method | Depth of Fine-grained Microstructure Layer (mm) | Equivalent Circular Grain Diameter of Fine-grained Microstructure Layer (mm) | Melting Region of Side Surfaces | Finishing Process: Method | Surface Roughness Ra (μm) | Flatness Index X (mm) |
|---|---|---|---|---|---|---|---|
| 36 | Electron Beam | 3.0 | 0.20 | One Part (to ⅙ t) | Grinder | 25.0 | 0.9 |
| 37 | Electron Beam | 5.2 | 0.30 | One Part (to ⅓ t) | Grinder | 20.0 | 0.8 |
| 38 | Electron Beam | 6.2 | 0.75 | One Part (to ⅓ t) | Milling Cutter | 5.0 | 2.9 |
| 39 | Electron Beam | 3.1 | 0.20 | One Part (to ⅓ t) | Milling Cutter | 24.0 | 1.4 |
| 40 | Plasma Arc | 9.4 | 0.90 | One Part (to ⅓ t) | Milling Cutter | 18.0 | 2.5 |
| 41 | Laser | 3.4 | 0.35 | One Part (to ⅓ t) | Grinder | 20.0 | 1.4 |
| 42 | TIG | 4.5 | 0.40 | One Part (to ⅓ t) | Grinder | 20.0 | 2.0 |

TABLE 6

| No. | First pass of rough rolling: Roll Surface Roughness Ra (μm) | Roll Radius (mm) | Original Plate Thickness (mm) | Plate Thickness After Rolling (mm) | Rolling Reduction (%) | Length of Arc of Contact of Roll (mm) | Evaluation of Surface Defects after Pickling of Hot-rolled Plate (defects in vicinity of edges) | Remarks |
|---|---|---|---|---|---|---|---|---|
| 36 | 0.7 | 1100 | 300 | 165 | 45 | 385 | A | Example |
| 37 | 0.6 | 950 | 300 | 195 | 35 | 316 | A | Example |
| 38 | 0.6 | 950 | 300 | 195 | 35 | 316 | B | Example |
| 39 | 0.7 | 950 | 300 | 210 | 30 | 292 | B | Example |
| 40 | 1.0 | 950 | 300 | 195 | 35 | 316 | B | Example |
| 41 | 0.7 | 950 | 200 | 130 | 35 | 258 | B | Example |
| 42 | 0.6 | 950 | 200 | 130 | 35 | 258 | B | Example |

TABLE 7

| | Starting Material for Hot Rolling | | | | | | | | | | | | | | |
|---|---|---|---|---|---|---|---|---|---|---|---|---|---|---|---|
| | Ingot Production | Chemical Composition (mass %) | | | | | | | | | | | | | |
| No. | Method | Al | Cu | Ni | Si | Sn | Nb | Pd | Ru | Mm | O | N | C | H | Ti |
| 43 | EBM | — | — | — | — | — | — | 0.06 | — | — | 0.042 | 0.005 | 0.005 | 0.015 | Bal. |
| 44 | EBM | — | — | 0.5 | — | — | — | — | 0.05 | — | 0.038 | 0.007 | 0.005 | 0.023 | Bal. |
| 45 | EBM | — | — | 0.5 | — | — | — | — | 0.05 | 0.003 | 0.044 | 0.005 | 0.005 | 0.012 | Bal. |
| 46 | PAM | — | 0.5 | — | — | — | — | — | — | — | 0.037 | 0.007 | 0.005 | 0.035 | Bal. |
| 47 | PAM | — | 1.0 | — | — | — | — | — | — | — | 0.038 | 0.005 | 0.005 | 0.021 | Bal. |
| 48 | PAM | — | 1.0 | — | — | — | 0.5 | — | — | — | 0.040 | 0.006 | 0.005 | 0.001 | Bal. |
| 49 | PAM | — | 1.0 | — | 0.30 | 1.0 | 0.2 | — | — | — | 0.035 | 0.008 | 0.005 | 0.023 | Bal. |
| 50 | EBR | 0.5 | — | — | 0.45 | — | — | — | — | — | 0.055 | 0.009 | 0.010 | 0.017 | Bal. |
| 51 | EBR | 0.9 | — | — | 0.35 | — | — | — | — | — | 0.050 | 0.010 | 0.010 | 0.021 | Bal. |

TABLE 8

| | Melting and Re-solidification Process | | | | Finishing Process | | |
|---|---|---|---|---|---|---|---|
| No. | Heating Method | Depth of Fine-grained Microstructure Layer (mm) | Equivalent Circular Grain Diameter of Fine-grained Microstructure Layer (mm) | Melting Region of Side Surfaces | Method | Surface Roughness Ra (μm) | Flatness Index X (mm) |
| 43 | Electron Beam | 3.3 | 0.20 | Entire Surface | Grinder | 13.0 | 0.6 |
| 44 | Electron Beam | 8.2 | 0.75 | Entire Surface | Grinder | 10.0 | 1.1 |
| 45 | Electron Beam | 8.2 | 0.75 | Entire Surface | Grinder | 22.0 | 1.1 |
| 46 | Electron Beam | 7.2 | 0.75 | Entire Surface | Grinder | 20.0 | 1.1 |
| 47 | Electron Beam | 6.7 | 0.05 | Entire Surface | Milling Cutter | 9.0 | 2.2 |
| 48 | Electron Beam | 3.2 | 0.04 | Entire Surface | Milling Cutter | 17.0 | 2.1 |
| 49 | Electron Beam | 5.3 | 0.02 | Entire Surface | Milling Cutter | 13.0 | 1.3 |
| 50 | Electron Beam | 6.3 | 0.03 | Entire Surface | Milling Cutter | 20.0 | 2.2 |
| 51 | Electron Beam | 7.3 | 0.05 | Entire Surface | Milling Cutter | 24.0 | 2.2 |

TABLE 9

| | First pass of rough rolling | | | | | | | |
|---|---|---|---|---|---|---|---|---|
| No. | Roll Surface Roughness Ra (μm) | Roll Radius (mm) | Original Plate Thickness (mm) | Plate Thickness After Rollin (mm) | Rolling Reduction (%) | Length of Arc of Contact of Roll (mm) | Evaluation of Surface Defects after Pickling of Hot-rolled Plate (defects in vicinity of edges) | Remarks |
| 43 | 0.9 | 800 | 200 | 120 | 40 | 253 | A | Example |
| 44 | 1.2 | 950 | 200 | 120 | 40 | 276 | A | Example |
| 45 | 1.0 | 950 | 200 | 120 | 40 | 276 | A | Example |
| 46 | 0.8 | 1000 | 200 | 130 | 35 | 265 | A | Example |
| 47 | 0.8 | 950 | 200 | 140 | 30 | 239 | A | Example |
| 48 | 0.8 | 950 | 200 | 140 | 30 | 239 | A | Example |
| 49 | 0.8 | 950 | 200 | 140 | 30 | 239 | B | Example |
| 50 | 0.8 | 950 | 200 | 138 | 31 | 243 | B | Example |
| 51 | 0.8 | 950 | 200 | 136 | 32 | 247 | B | Example |

Note that, in Tables 3, 6 and 9, "surface roughness of roll" means "the surface roughness of the rolling roll in the first pass of rough rolling", "roll radius" means "radius of the rolling roll in the first pass of rough rolling", "original plate thickness" means "thickness of central part in the width direction of the titanium slab after the finishing process", "plate thickness after rolling" means "thickness of central part in the width direction of the titanium slab on the delivery side in the first pass of rough rolling", and "length of arc of contact of roll" means the "length of the arc of contact of the roll in the first pass of rough rolling".

As shown in Tables 1 to 9, in Nos. 1 and 2, the depth of the fine-grained microstructure layer was not sufficient, with the depth of the fine-grained microstructure layer being less than 3 mm. In No. 4, the equivalent circular grain diameter of the fine-grained microstructure layer was 1.60 mm, which was too large. In No. 8, the flatness index X with respect to the rolling surface after the finishing process was 4.0, which was a high value. In Nos. 9 and 10, the length of the arc of contact of the roll for the first pass of rough rolling was small.

As a result, in Nos. 1 and 2, 4, and 8 to 10, deep defects were present at end parts in the width direction of the rolling surfaces of the hot-rolled titanium plate, and the quality of the hot-rolled titanium plate was poor. In contrast, in each of Nos. 3, 5 to 7, and 11 to 51 that satisfied the conditions defined by the present invention, defects at the end parts in the width direction of the rolling surface of the hot-rolled titanium plate were "minor" or "somewhat large defects", and the surface properties of the hot-rolled titanium plate were good.

REFERENCE SIGNS LIST

10 Titanium slab
10A, 10B Side surface
10C, 10D Surface to be rolled
10P Unevenness of casting surface
10Q Defect
12 Electron beam radiation gun
14 Irradiated region
16 Melting and re-solidification
18 Heat-affected zone layer (HAZ layer)
20 Fine-grained microstructure layer
24 Rolling roll
D Rolling direction
L Length of arc of contact of roll

The invention claimed is:

1. A method for producing a titanium plate by performing hot rolling on a titanium slab that is directly produced by using an electron beam re-melting process or a plasma arc melting process, comprising:

when a face of the titanium slab to be rolled when the slab is subjected to hot rolling is defined as a "surface to be rolled", and a face that is parallel to a rolling direction and is perpendicular to the surface to be rolled is defined as a "side surface",

[1] a step of melting at least one part on the surface to be rolled side of the side surface of the titanium slab by radiating a beam or plasma toward the side surface without radiating a beam or plasma toward the surface to be rolled, and thereafter causing re-solidification to form a microstructure layer having an equivalent circular grain diameter of 1.5 mm or less to a position at a depth of at least 3.0 mm from a surface of the side surface in at least one part of the side surface;

[2] a step of performing a finishing process on the surface to be rolled of the titanium slab in which the microstructure layer is formed to bring X defined by formula (1) below to 3.0 or less; and

[3] a step of subjecting the titanium slab after the finishing process to hot rolling under a condition in which L defined by (2) below is 230 mm or more;

$$X=(\text{largest value among } H_0, H_1 \text{ and } H_2)-(\text{smallest value among } H_0, H_1 \text{ and } H_2) \quad (1)$$

$$L=\{R(H_0-H_3)\}^{1/2} \quad (2)$$

where, the meaning of the symbols in the above formulae is as follows:

X: slab flatness index $H_0$: thickness of a central part in a width direction of the titanium slab after the finishing process (mm)

$H_1$: thickness of an end part (position at ⅛ of the width) in a width direction of the titanium slab after the finishing process (mm)

$H_2$: thickness of an end part (position at ¼ of the width) in a width direction of the titanium slab after the finishing process (mm)

L: length of arc of contact of a roll in a first pass of rough rolling (mm)

R: radius of a rolling roll in a first pass of rough rolling (mm)

$H_3$: thickness of a central part in the width direction of the titanium slab on a delivery side in a first pass of rough rolling (mm);

wherein, in the step of [1], in the side surface, the microstructure layer is formed in a region from the surface to be rolled to a position at least ⅙ of the thickness of the titanium slab.

2. The method for producing a hot-rolled titanium plate according to claim 1, wherein, in the step of [1], the microstructure layer is formed over all of the side surface.

3. The method for producing a hot-rolled titanium plate according to claim 1, wherein, in the step of [1], in the side surface, the microstructure layer is formed in a region from the surface to be rolled to a position at least ⅓ of the thickness of the titanium slab.

4. The method for producing a hot-rolled titanium plate according to claim 1, wherein, in the step of [2], a surface roughness (Ra) of the surface to be rolled is made 0.6 μm or more.

5. The method for producing a hot-rolled titanium plate according to claim 1, wherein, in the step of [3], the radius of the rolling roll in the first pass of rough rolling is more than 650 mm.

6. The method for producing a hot-rolled titanium plate according to claim 1, wherein, in the step of [3], a rolling reduction in the first pass of rough rolling is 30% or more.

7. The method for producing a hot-rolled titanium plate according to claim 1, wherein, in the step of [3], a surface roughness (Ra) of the rolling roll is 0.6 μm or more.

8. The method for producing a hot-rolled titanium plate according to claim 2, wherein, in the step of [2], a surface roughness (Ra) of the surface to be rolled is made 0.6 μm or more.

9. The method for producing a hot-rolled titanium plate according to claim 2, wherein, in the step of [3], the radius of the rolling roll in the first pass of rough rolling is more than 650 mm.

10. The method for producing a hot-rolled titanium plate according to claim 4, wherein, in the step of [3], the radius of the rolling roll in the first pass of rough rolling is more than 650 mm.

11. The method for producing a hot-rolled titanium plate according to claim 8, wherein, in the step of [3], the radius of the rolling roll in the first pass of rough rolling is more than 650 mm.

12. The method for producing a hot-rolled titanium plate according to claim 2, wherein, in the step of [3], a rolling reduction in the first pass of rough rolling is 30% or more.

13. The method for producing a hot-rolled titanium plate according to claim 4, wherein, in the step of [3]

a rolling reduction in the first pass of rough rolling is 30% or more.

14. The method for producing a hot-rolled titanium plate according to claim 8, wherein, in the step of [3], a rolling reduction in the first pass of rough rolling is 30% or more.

15. The method for producing a hot-rolled titanium plate according to claim 2, wherein, in the step of [3], a surface roughness (Ra) of the rolling roll is 0.6 μm or more.

16. The method for producing hot-rolled titanium plate according to claim 4, wherein, in the step of [3], a surface roughness (Ra) of the rolling roll is 0.6 μm or more.

17. The method for producing a hot-rolled titanium plate according to claim 8, wherein, in the step of [3], a surface roughness (Ra) of the rolling roll is 0.6 μm or more.

* * * * *